United States Patent [19]

Marsh

[11] 4,270,825

[45] Jun. 2, 1981

[54] ELECTRICAL CONNECTOR ASSEMBLY

[75] Inventor: Edward K. Marsh, Sidney, N.Y.

[73] Assignee: The Bendix Corporation, Southfield, Mich.

[21] Appl. No.: 82,439

[22] Filed: Oct. 9, 1979

[51] Int. Cl.[3] ..... H01R 4/10; H01R 13/422

[52] U.S. Cl. ..... 339/47 R; 339/217 S; 339/276 T

[58] Field of Search ..... 339/47 R, 49 R, 59 R, 339/59 M, 276 T, 217 S, 252 P

[56] References Cited

U.S. PATENT DOCUMENTS

| | | | |
|---|---|---|---|
| 3,673,541 | 6/1972 | Volinskie | 339/217 S |
| 3,725,844 | 4/1973 | McKeown et al. | 339/49 R |
| 4,120,556 | 10/1978 | Waldron et al. | 339/276 T |
| 4,221,446 | 9/1980 | Niles et al. | 339/49 R |

FOREIGN PATENT DOCUMENTS

| | | | |
|---|---|---|---|
| 2163807 | 6/1973 | Fed. Rep. of Germany | 339/217 S |
| 1375854 | 11/1974 | United Kingdom | 339/252 P |

*Primary Examiner*—Neil Abrams

*Attorney, Agent, or Firm*—David R. Syrowik; Charles D. Lacina; Kenneth A. Seaman

[57] ABSTRACT

An electrical connector assembly (10) having an improved electrical contact (12) that includes an inner drawn holder (22) and an outer drawn sleeve (20) and a method of making the assembly (10) is disclosed. A bunch of electrical conducting fine wires (24) are axially aligned and crimped within an end portion (27) of a passage (25) which extends completely through the holder (22) such that the wires (24) extend beyond one end (26) of the holder (22). The opposite end (48) of the holder (22) is adapted to receive a wire (54) stripped of insulation (55) so that the end (56) of the wire (54) engages the opposite end (52) of the wires (24) in electric circuit relationship therebetween. The outer sleeve (20) also has an axially extending passage (21) extending completely therethrough. The end portion (40) of the passage (21) of the sleeve (20) has a cross-sectional area larger than the cross-sectional area of an interior portion (38) of the passage (21) to permit the spreading of the wires (24) in the end portion (40) of the sleeve passage (21). The electrical contact (12) is releasably secured within an insert (14) which includes integrally formed, radially deflectable contact retaining fingers (18) to secure the contact (12) in the insert (14) about a flared annular retaining shoulder (58).

1 Claim, 5 Drawing Figures

5
5

ELECTRICAL CONNECTOR ASSEMBLY

TECHNICAL FIELD

This invention relates to electrical connector assemblies including electrical contacts comprising two elongated telescoping sleeves having a plurality of electrical conducting wires axially aligned and axially mounted within the sleeves.

BACKGROUND ART

Prior patents disclose a single housing having a machined shoulder and machined axial passage for receiving an electrical conductor and for receiving a plurality of fine wires having tapered or angled surfaces at their ends. For example, the U.S. patent of McKeown et al. U.S. Pat. No. 3,725,844 issued Apr. 3, 1973 and assigned to the assignee of the present application and which is hereby incorporated herein by reference, discloses a crimp type brush contact which is machined as a one-piece brass part. Generally, electrical contacts are machined from metal stock and because of their small size the contacts are machined to tolerances of 0.002 inches or less. A contact which is oversized for any reason cannot be utilized because it may not be possible to insert such a contact into the contact receiving holes of a connector insert or insufficient clearance between adjacent contacts may cause electrical or mechanical problems.

Machining of electrical contacts is expensive and because of the large number of small contacts utilized by a particular electrical connector, the connector is expensive. One way to reduce the cost of manufacturing the connector and at the same time provide an electrical contact that provides a secure mechanical and electrical connection when a wire is crimped to the contact is to make an electrical contact by stamping and rolling (forming) electrical contacts from a sheet of metal. The U.S. patent of Waldron et al U.S. Pat. No. 4,072,394 issued Feb. 7, 1978 and assigned to the assignee of the present application and which is hereby incorporated herein by reference, discloses a three-piece electrical contact assembly which includes an inner sleeve and first and second outer sleeves telescopically located over the front and rear portions of the inner sleeve.

Generally each of the contacts within a connector assembly is removable so that it may be connected, for example, by crimping to an incoming wire when electronic equipment is installed. Ordinarily, each of the incoming wires to the connector is attached to its respective contact by inserting the electrical wire into an axial opening machined in one end of the contact and then crimping the contact to the wire to obtain an electrical and mechanical connection. The crimping operation is performed by a well-known plier type tool that, when squeezed, applies pressure simultaneously to two pairs of diametrically opposed points in a circumference of the contact to form the contact into the wire in the contact. After the crimping operation, each of the contacts is inserted into the connector assembly where they are retained by a contact retention mechanism.

The present invention is also related to the invention disclosed in United States patent application Ser. No. 948,112 entitled "Electrical Contact For An Electrical Connector", filed in September of 1978. The patent application discloses an electrical contact including a first body piece, a plurality of axially aligned wires and a sleeve piece mounted on the body piece at its forward end and crimped in place. The wall portion of the body piece is cut off and bent inward to provide a rear stop for the wire. The forward end of an inserted conductor contacts a rear face of the wall portion and thereafter the body piece and the conductor are crimped together.

DISCLOSURE OF THE INVENTION

An object of the present invention is to provide an improved two-piece drawn contact having several electrical conducting wires axially aligned and axially mounted within an end portion of one of the pieces. The other end portion of the same piece is adapted to receive an electrical conductor for engagement with the inserted end of the wires thereby providing a secondary current path directly between the wires and the inserted conductor.

Another object of this invention is to provide a two-piece contact assembly that is simple in construction and economical to manufacture.

A further object of the invention is to replace expensive machined electrical contacts with inexpensive electrical contacts that are drawn from tube stock.

It is also an object of this invention to provide an electrical contact drawn from tube stock which, when crimped to a wire, will provide a secure mechanical and good electrical connection to the wire.

It is also another object of the invention to provide an electrical contact that can be fabricated relatively easily in large quantities and low cost.

Yet another object of the invention is to provide an electrical connector assembly and method of making the assembly and having an improved contact whose construction allows for it to be easily held therein.

In carrying out the above objects and other objects of this invention, the preferred embodiment of an electrical contact constructed in accordance with the invention includes an elongated body (20) having an axial body passage (21) extending completely therethrough between first and second ends; an elongated electrical conductor (22) having an axial conductor passage (25) extending completely therethrough, the conductor being axially aligned and axially mounted within the passage of the elongated body so that the conductor extends beyond the second end of the elongated body. The contact (12) also includes several electrical conducting wires (24) axially aligned and axially mounted within a first end portion (27) of the conductor passage. Each of the wires includes an end portion that terminates in an acutely angled surface (28) and wherein a second end portion (44) of the conductor passage is adapted to receive an electrically conducting body (54) therein for engaging the ends (52) of the wires in electrical circuit relationship.

In carrying out the above objects and other objects of this invention, a preferred method of making an electrical connector assembly includes the steps of: positioning an elongated electrical conductor having an axial passage extending completely therethrough; aligning an elongated body having a flanged end portion extending radially outwardly and an axial passage extending completely therethrough over the conductor; inserting axially aligned electrical conducting wires in one end of the conductor; securing the wires and the conductor and the body together; inserting an electrically conducting body in the opposite end of the conductor to engage the ends of the wires in electrical circuit relationship; and securing the conducting body and conductor together.

The objects, features and advantages of the present invention are readily apparent from the following detailed description of the best mode taken in connection with the accompanying drawings.

BEST MODE FOR CARRYING OUT THE INVENTION

Figures 1, 2, 3, 4, 5:
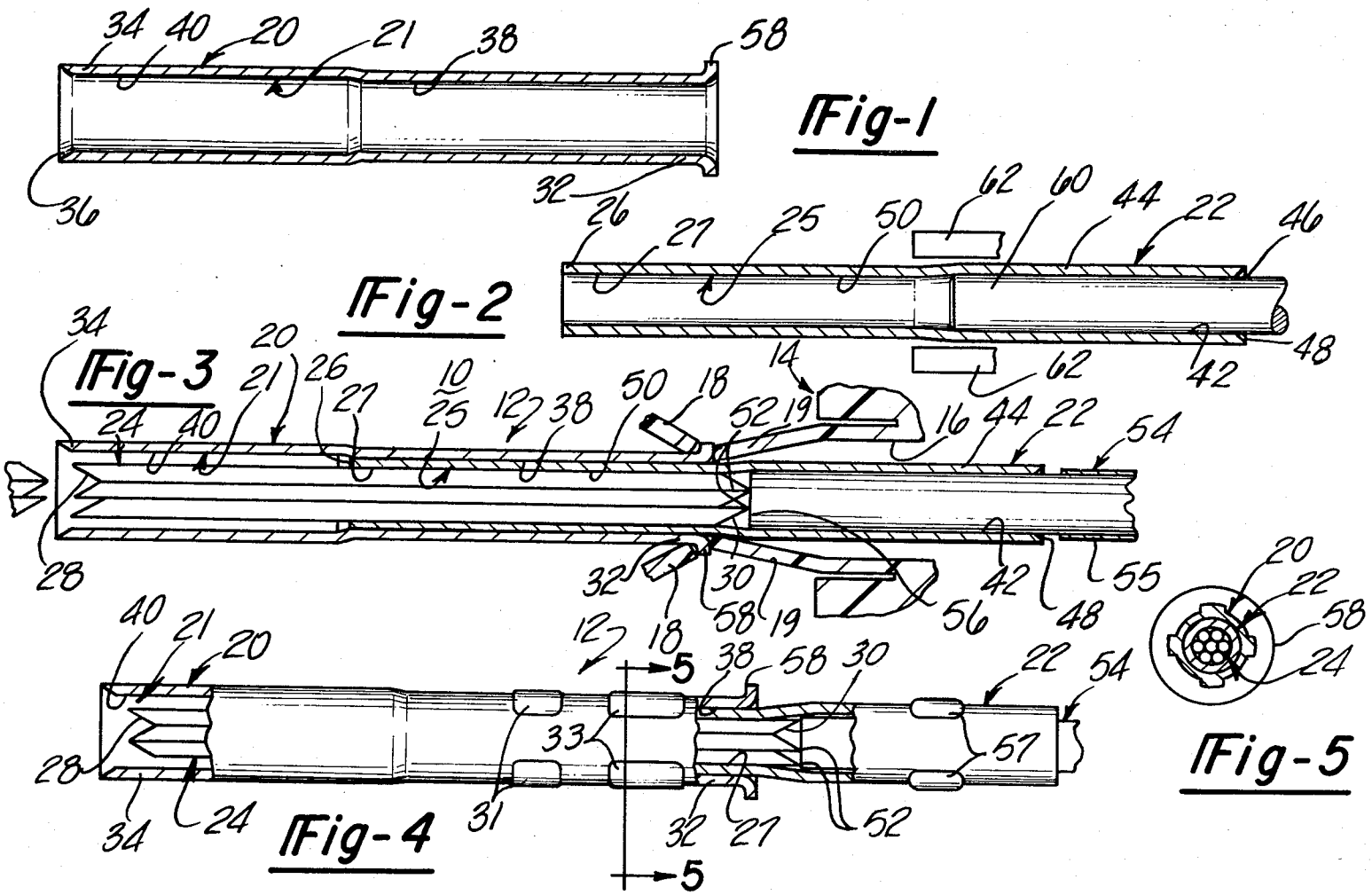
FIG. 1 is a view which shows an outer elongated body of an electrical connector assembly constructed according to this invention.
FIG. 2 is a view which shows the inner elongated conductor of the electrical connector assembly and a method of making the assembly.
FIG. 3 is a view which shows the contact connected to an electrical wire and mounted in a housing without any crimps.
FIG. 4 is a view showing the outer body, the inner conductor and fine wires crimped together and the electrical wire crimped in the inner conductor.
FIG. 5 is a view taken along line 5—5 of FIG. 4.

Referring to FIG. 3, an electrical connector assembly constructed according to the present invention is indicated collectively by reference numeral 10 and includes an electrical contact generally indicated at 12 and a housing which may comprise a dielectric insert generally indicated at 14 for retaining the contact 12 in a passage 16 of the insert 14. The insert 14 includes two pairs of opposing radially deflectable contact retaining fingers 18 and 19 integral with the insert 14. The first and second pairs of fingers 18 and 19 both function as stop or latch members to releasably limit movement of the contact 12 within the housing passage 16. Such inserts are shown in U.S. Pat. No. 4,082,308 entitled "Electrical Connector With Front and Rear Insertable and Removable Contacts" issued Apr. 4, 1978 and having a common assignee as the present application or as shown in U.S. Pat. No. 4,157,806 entitled "Apparatus for Making Electrical Connector Insert" issued June 12, 1979 and also having the common assignee as the present application. Both of the patents mentioned immediately above are hereby incorporated herein by reference.

Referring to FIG. 1, the contact 12 includes an elongated tubular body or an outer electrical conductor or sleeve generally indicated at 20 having an axial passage generally indicated at 21, extending completely therethrough. A forward end portion 40 of the passage 21 of the sleeve 20 has a cross-sectional area larger than the cross-sectional area of a rearward end portion 38 of the passage. Sleeve 20 is of stainless steel drawn from tube stock. In one type of contact assembly the sleeve 20 is about 0.37 inches long.

Referring to FIG. 2, the contact 12 also includes an elongated electrical conductor or tubular holder generally indicated at 22 having an axial passage generally indicated at 25 extending completely therethrough. The holder 22 comprises a brass sleeve which is drawn from tube stock and then plated with gold or tin thereon to provide good electrical current carrying characteristics as described in previously mentioned U.S. Pat. No. 4,072,394. In one type of contact assembly the holder 22 is also about 0.37 inches long.

Referring to FIGS. 3 and 4, the contact 12 also includes a plurality of electrical conducting fine brush wires generally indicated at 24 which are axially aligned and axially mounted within passage 25 of the holder 22 so that the wires 24 extend beyond one end 26 of the holder 22. The ends of the wires 24 have acutely angled, or tapering, end surfaces 28 and 30, preferably having a 30° included angle.

The holder 22 is axially aligned and axially mounted within the end portion 38 of the sleeve passage 21 so that the holder 22 extends beyond one end 32 of the sleeve 20. The sleeve 20 is secured in place and the wires 24 are secured within the holder 22 by a plurality of radially extending crimp joints formed at two spaced crimping positions 31 and 33 as shown in FIGS. 4 and 5 which prevent the sleeve 20 or the wires 24 from moving axially or radially with respect to the holder 22. Such crimps and apparatus for making such crimps in an automated process are well-known in the art. The preferred method of securing the wires 24 within the holder 22 and the holder 22 within the sleeve 20 is to make the sleeve securing crimps and the wire securing crimps simultaneously.

The axial passage 25 of the holder 22 includes a first end portion 27 and a second end portion 44 which terminates in a chamfered opening 46 at the end 48 of the holder 22 and which has a cross-sectional area 42 larger than the cross-sectional area of an interior passage portion 50 of the passage 25. The wires 24 are disposed in the interior passage portion 50, the ends 52 of the wires 24 extending to a position immediately adjacent the second end portion 44 of the passage 25. An electrically conducting body or a wire conductor generally indicated at 54 is inserted into the holder as shown in FIGS. 3 and 4 so that its forward end 56 having insulation 55 stripped away, engages the end 52 of the wires 24 in mechanical and electrical circuit relationship thereby providing a current path to the wires 24, secondary to the current flow through the holder 22 between the crimp joints 31 and 33. Thereafter the conductor wire 54 is secured in place in the holder 22 by suitable means such as by crimping the holder 22 to the conductor wire 54 at a crimping position 57 similar to crimping positions 31 and 33.

The sleeve 20 also includes an outwardly flared retaining flange or enlarged shoulder portion 58 integrally formed therewith at the one end 32. The shoulder portion 58 is flared to facilitate the positioning of the sleeve 20 over the holder 22 as will be described in greater detail hereinafter. The retaining fingers 18 removably secure the contact 12 to be removed from the insert 14 by a suitable tool (not shown) inserted through the passage 16 to deflect the fingers 18.

The steps associated with making the electrical connector assembly are illustrated in FIGS. 2 and 4. Initially the holder 22 and the sleeve 20 are drawn and formed out of tube stock to the shapes shown in FIGS. 2 and 1, respectively. Thereafter the holder 22 is plated in a gold or tin solution to provide the holder with good current carrying characteristics. Thereafter the holder 22 is positioned on a locating pin 60, the locating pin 60 extending within the passage 25 up to the interior passage portion 50 wherein the passage 25 begins to narrow. The locating pin 60 has approximately the same diameter as the conductor wire 54.

Then the sleeve 20 is slid over the holder 22 until the enlarged shoulder portion 58 engages stops 62 circumferentially arranged about the axis of the locating pin 60. The wires 24 are guided by the chamfered end surface 36 of the end portion 34 as they are inserted within the axial passage 25 of the holder 22 until the ends 52 engage the locating pin 60. The wires 24, the sleeve 20 and the holder 22 are then secured together by crimping them at the crimp joints 31 and 33. The contact 12 is then removed from the locating pin 60 and the conductor 54 is guided by the chamfered end surface 46 as it is inserted within the end portion 44 of the passage 25 until the forward end 56 of the conductor 54 engages the ends 52 of the wires 24 in electrical circuit relationship. The conductor 54 is then secured within the holder 22 by crimping in a well-known fashion at the crimping position 57.

The front portion 34 of the stainless steel sleeve 20 provides the necessary mechanical strength to the completed assembly 10 to protect the wires 24.

The crimp joints 31 and 33 push the sleeve 20 and the holder 22 inwardly so that the holder 22 is crushed into the wires 24 as shown in FIG. 5 to form a good electrical and mechanical connection and, furthermore, the crimp joints 31 and 33 prevent the wires 24 from separating from the holder 22 and the holder 22 from separating from the sleeve 20 if a rearward axial force is placed on the connected conductor wire 54. Rather, the conductor wire 54 will separate from the portion 44 of the holder 22 before the holder 22 and sleeve 20 of the contact 12 separate.

While the preferred embodiment of the contact, the connector assembly and a method for making the connector assembly have been shown and described herein in detail, those skilled in this art will recognize various alternative designs and embodiments for practicing the present invention as defined by the following claims.

What is claimed is:

1. An electrical connector assembly adapted for a mating with a second electrical connector assembly in terminating an electrically conducting body, the assembly comprising:

a housing having a housing passage formed therethrough;

an elongated body having an axial body passage extending completely therethrough between first and second ends, wherein the elongated body comprises an electrically conducting member and wherein the axial body passage includes first and second end portions that terminate in openings at the respective first and second ends of said body and an interior passage portion, the first end portion of said body passage having a cross-sectional area larger than the cross-sectional area of the interior passage portion, the first end of said electrically conducting member including a radially outwardly flared annular retaining flange;

an elongated electrically conductive member having an axial member passage extending completely therethrough, said axial member passage including first and second end portions and an interior passage portion medial the end portions thereof, the second end portion of the member passage terminating in an opening at the second end of said member, the second end portion of said member passage having a cross-sectional area greater than the cross-sectional area of the interior passage portion of said member, said member first end being axially aligned and axially mounted within the axial body passage of the body so that said member second end extends beyond the second end of said elongated body and into said housing passage;

several electrical conducting wires axially aligned and axially mounted within the first end portion of the member passage, each of said wires including an end portion which terminates in an acutely angled surface, the ends of the wires being disposed at a position medially the second portion and the interior passage portion for engagement by the electrically conducting body, wherein a second end portion of said member passage is adapted to receive the electrically conducting body therein for engaging the ends of said wires in electrical circuit relationship, said wires being mounted in said interior passage portion of said first member being a pair of axially spaced crimp joints of said first member, said second member and said first member being connected to said wires in electric relationship at the crimp joints; and retaining means coupled to said housing for releasably securing said contact within said housing passage, said retaining means securing the contact within the housing passage at said retaining flange and including at least one radially deflectable contact retaining finger integrally connected to said housing for abuttingly engaging said electrically conducting member at said retaining flange.

* * * * *